United States Patent [19]

Harrington

[11] 4,031,858

[45] June 28, 1977

[54] STOCK HANDLING DEVICE

[76] Inventor: Brian Mervyn Harrington, P.O. Box 43, Darkan, 6392, Australia

[22] Filed: Dec. 23, 1975

[21] Appl. No.: 643,942

[52] U.S. Cl. ..... 119/103

[51] Int. Cl.[2] ..... A61D 3/00

[58] Field of Search ..... 119/103, 98, 99; 269/323

[56] References Cited

UNITED STATES PATENTS 3,319,608 5/1967 Klooster ..... 119/103 X

FOREIGN PATENTS OR APPLICATIONS 212,637 8/1957 Australia ..... 119/98

*Primary Examiner*—Hugh R. Chamblee

[57] ABSTRACT

A cradle is shaped to receive and support an animal in an inverted position; the cradle is pivotally mounted on a frame for rotation about a first substantially horizontal axis which coincides with one side of the cradle and latching means are mounted on the frame for holding the cradle in a horizontal position; the latching means may be released to permit the cradle to rotate about the first horizontal axis to discharge the animal therefrom, and animal tipping means receive an animal and may be rotated about a second substantially horizontal axis to an inverted position to discharge the animal into the cradle in an inverted position. The tipping means have two opposed side walls and a floor, one side wall is fixed lying adjacent the cradle; the other side wall is remote from the cradle and may be moved inwardly from an outermost position to clamp an animal within the tipping means against the one side wall during the rotation of the animal tipping means to a discharge position. The tipping means is also provided with gate means at the entry thereof and can be closed upon an animal entering the tipping means to prevent animals backing therefrom. The gate means is adapted to open when an animal is tipped from the tipping means.

10 Claims, 4 Drawing Figures

STOCK HANDLING DEVICE

This invention relates to an improved stock handling device wherein an animal may be held immobile permitting it to be freely operated upon.

In one form the invention resides in a cradle shaped to receive and support an animal in an inverted position; the cradle is pivotally mounted on a frame for rotation about a first substantially horizontal axis which coincides with one side of the cradle;

a. latching means mounted on the frame for holding the cradle in a horizontal position; the latching means may be released to permit the cradle to rotate about the first horizontal axis to discharge the animal therefrom; and b. animal tipping means to receive an animal and capable of being rotated about a second substantially horizontal axis to an inverted position to discharge the animal into the cradle in an inverted position. The tipping means have two opposed side walls and a floor, one side wall is fixed lying adjacent the cradle; the other side wall is remote from the cradle and may be moved inwardly from an outermost position to clamp an animal within the tipping means against the one side wall during the rotation of the animal tipping means to a discharge position. The tipping means is also provided with gate means at the entry thereof and can be closed upon an animal entering the tipping means to prevent animals backing therefrom; the gate means is adapted to open upon an animal being tipped from the tipping means.

The invention will be more fully understood in the light of the following description of one specific embodiment. The description is made with reference to the accompanying drawings of which:

Figure 1:
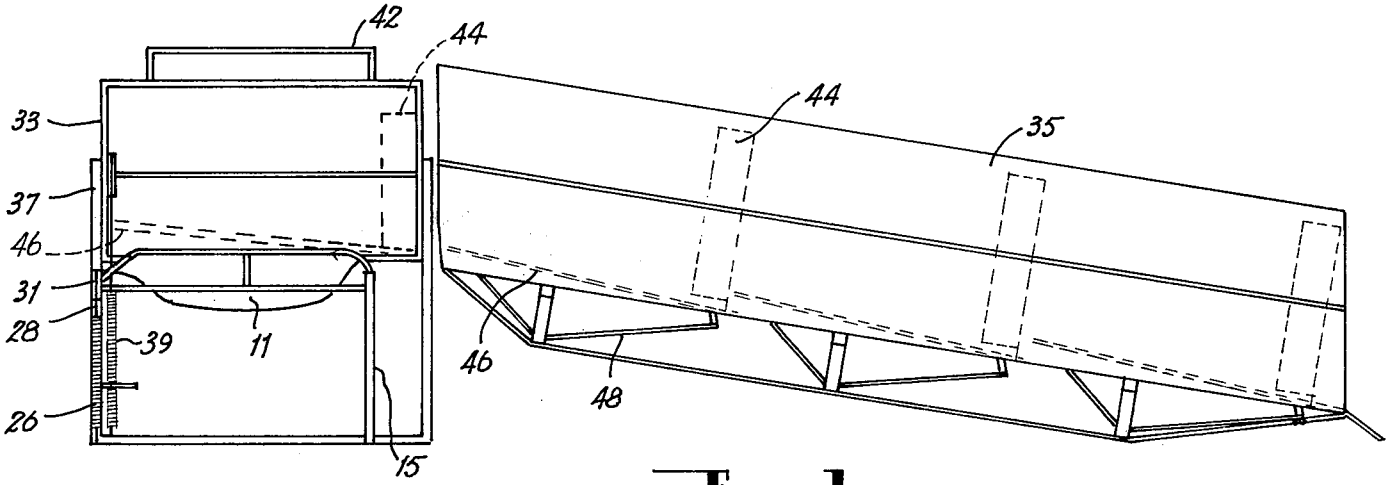
FIG. 1 is a side elevation of the embodiment.
Figure 4:
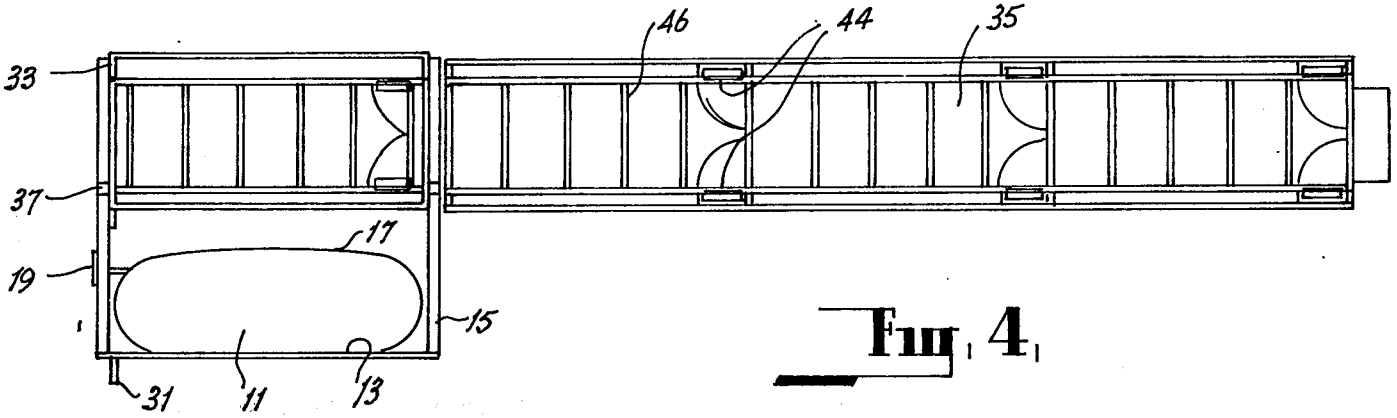
FIG. 4 is a plan view of FIG. 1.
Figure 2:
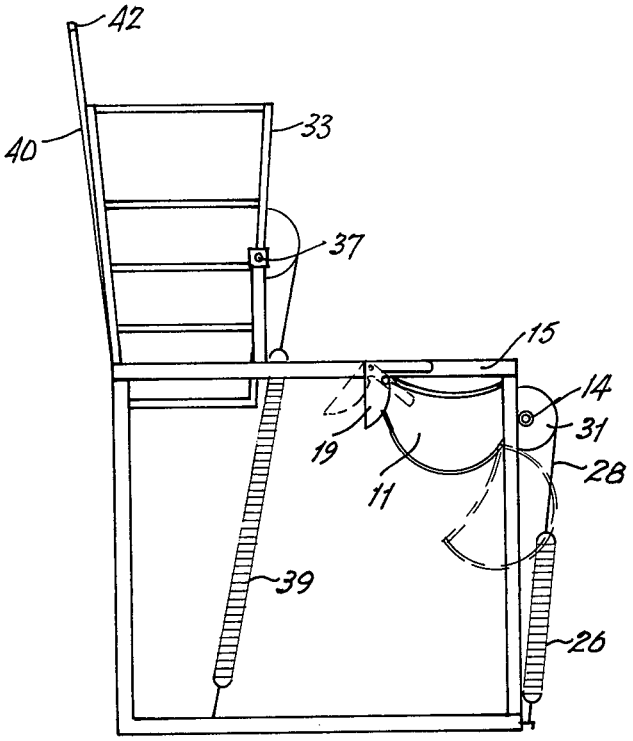
FIG. 2 is an end elevation of FIG. 1.

The embodiment comprises a sheep handlng device wherein a sheep can be immobilised permitting it to be operated on according to any of the standard routine procedures. It is a fact that a sheep when placed upon its back in a channel shaped receptacle becomes immobile requiring no special means for holding it in position. The invention relies upon this fact to carry out its object.

The embodiment comprises a cradle 11 having a channel shape in order to receive and support a sheeps back. The cradle is substantially U-shaped in transverse cross-section and the sides slope outwardly to wedgingly receive the sheeps back, such wedging engagement enables the cradle to receive and hold all sheep whether they are lambs or mature sheep and whether they are in full wool or newly shorn. The shape is such that there is no restraint required for the sheep and no special mechanism for altering the shape of the cradle to accommodate differing sized animals. In addition the cradle is curved in the longitudinal plane such that the ends curve upwards to support the head and hindquarters of the sheep. The cradle 11 is pivotally mounted along one edge 13 about pivot point 14 to support frame 15 to pivot about a substantially horizontal axis. The other side 17 of the cradle 11 is engaged and supported by a latch 19. The latch is connected to a hand operated lever. Upon operation of the hand lever the latch 19 is released from engagement with the cradle to permit it to pivot downwardly as shown in the broken lines. The latch 19 is maintained in the cradle engaging position by means of a return spring which is mounted between the frame 15 and the hand lever. The cradle is biassed to the horizontal position by means of a return spring 26 connected between the frame and cradle through a cable 28 and pulley wheel 31.

Figure 3:
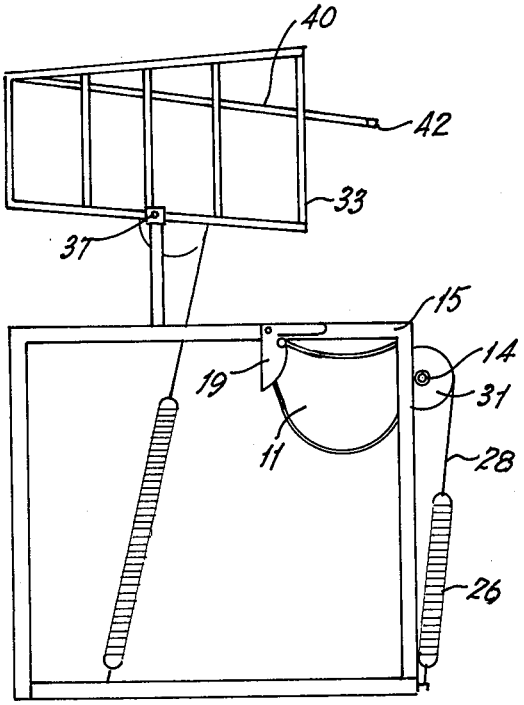
FIG. 3 is an end elevation of FIG. 1 showing an end portion of the race in the tipping position.

The frame 15 also supports a tiltable pen 33 which is located at the upper end of the inclined race 35. The pen is pivotable about point 37 on the frame 15 and is counterbalanced by spring 39 between the frame and the pen such that minimal effort is required to rotate the pen about point 37. The side wall 40 of the pen furthermost from the cradle is pivotally mounted to the floor of the pen 33 and is provided with a handle 42 along its upper edge. When the operator reaches across the cradle to pull the pen 33 over by grasping handle 42 the pulling on the handle 42 also pivots the wall 40 against the sheep in the pen to retain it in the pen during the tilting action. Means may be incorporated in the side wall 40 such that as the wall is pivotted with respect to the pen 33 a portion of the wall remains substantially perpendicular with the floor of the pen and wherein this portion acts in clamping against the sheep. The pen may be tilted beyond the position shown in FIG. 3 such that the sheep will slip from the pen into the cradle to lie on its back in the cradle. The pen is also provided with gate means (not shown) at the entry thereto to control the movement of sheep into the pen. The gate means are such that they are open when the pen is empty and are closed when a sheep has entered the pen, wherein the entry of sheep into the pen closes the gate means.

The inclined race 35 from ground level to the pen 33 is provided along its length with a series of pairs of gates 44 which are intended to divide the length into a number of stations each intended to house one sheep at a time. The gates are operated by the weight of the sheep causing the floor 46 in each station at their lower end and through the lever linkage 48 between the upper end of the floor and the set of gates 44 at the lower end to open or close in response. When a station is empty the floor 46 is inclined to the floor line in general and the gates 44 at the lower end of the station are open. As a sheep enters the station the floor 46 pivots downwards causing the gates 44 through levers 48 to close. Upon the sheep departing a station for another further up the race 35 the floor 46 pivots upwards causing the gates 44 to open in the station so permitting another sheep to enter it. The floor of the pen 33 also preferably has the same mounting as the floors 46 of the race, to operate the set of gates at the entry to the pen.

In use the lower end of the race 35 communicates with a holding pen for the sheep and the region around the cradle into which it tips, downwardly communicates with a race or holding area. The sheep enter the race 35 individually and pass up the race from station to station and so individually into the pen 33. The pen is tilted towards the cradle 11 by the operator grasping the handle 42 and in so doing retaining the sheep in the pen while it is being tilted. When the opening of the top of the pen 33 is adjacent the cradle, the operator releases the handle 42 and the sheep slides into the cradle 11 to lie on its back. The removal of the weight of the sheep from the pen 33 then permits the pen to pivot back ready to receive another sheep.

I claim:

1. A stock handling device comprising:

a. a cradle shaped to receive and support an animal in an inverted position, the cradle being pivotally mounted on a frame for rotation about a first substantially horizontal axis coinciding with one side of the cradle;

b. latching means mounted on the frame for holding the cradle in a horizontal position, the latching means being releasable to permit the cradle to rotate about the first horizontal axis to discharge the animal therefrom; and c. animal tipping means rotatable on said frame and having an entry to receive an animal and capable of being rotated about a second substantially horizontal axis to an inverted position to discharge the animal into the cradle in an inverted position, the tipping means having two opposed side walls and a floor, one of said side walls being fixed lying adjacent the cradle, the other of said side walls being remote from the cradle and movable inwardly from an outermost position to clamp an animal within the tipping means against the one of said side walls during the rotation of the animal tipping means to a discharge position, said tipping means also being provided with gate means at the entry thereof and closeable upon an animal entering the tipping means to prevent animals backing therefrom, said gate means being adapted to open upon an animal being tipped from the tipping means.

2. A stock handling device as claimed in claim 1 wherein the cradle is biassed to the substantially horizontal position by a counter balancing means between the frame and cradle, the biassing force being such that the weight of the sheep in the cradle will counter the biassing force.

3. A stock handling means as claimed in claim 1 wherein the race in which the tipping means is located is subdivided into a series of stations, each station having associated with it a gate means which will close upon an animal entering the station to prevent the animal moving backwards along the race.

4. A stock handling device as claimed in claim 1 wherein the cradle is substantially U-shaped in transverse cross-section such that the sides thereof slope upwardly and outwardly to wedgingly receive an animal's back, and wherein the cradle is additionally curved upwardly at either end thereof to support the head and hindquarters of the animal in the cradle.

5. A stock handling device as claimed in claim 1 further comprising counter balancing means for biasing the cradle to the substantially horizontal position, said counter balancing means being disposed between the frame and cradle, and having a biasing force for the weight of the animal in the cradle to counter the biasing force.

6. A stock handling device as claimed in claim 1 further comprising a race having a length, the tipping means being located in the length of the race.

7. A stock handling device as claimed in claim 1 wherein the rotatable mounting of the tipping means to the frame is located on the side wall adjacent the cradle.

8. A stock handling device as claimed in claim 1 wherein the animal tipping means is located alongside the cradle with a space formed therebetween and wherein the cradle is pivotable in the direction of the tipping means to deposit the animal in said space upon said latching means being released.

9. A stock handling device as claimed in claim 6 wherein the race in which the tipping means is located is subdivided into a series of stations, each station having associated therewith gate means closeable upon an animal entering the station to prevent the animal moving backwards along the race.

10. A stock handling device as claimed in claim 1 wherein said tipping means is provided with a floor pivotally mounted to said tipping means along one edge thereof, said floor being movable between uppermost and lowermost positions, and biased to occupy the uppermost position for the floor to pivot to the lowermost position upon an animal entering the tipping means, said floor being operatively connected to said gate means at the entry of the tipping means to maintain the gate means open when in the uppermost position and closed when in the lowermost position.

* * * * *